US008910883B2

(12) United States Patent
Mattheus

(10) Patent No.: US 8,910,883 B2
(45) Date of Patent: Dec. 16, 2014

(54) CAP FOR A DRINKING STRAW

(76) Inventor: Christiaan Mattheus, Monaco (MC)

( * ) Notice: Subject to any disclaimer, the term of this patent is extended or adjusted under 35 U.S.C. 154(b) by 490 days.

(21) Appl. No.: 13/288,878

(22) Filed: Nov. 3, 2011

(65) Prior Publication Data

US 2012/0067909 A1 Mar. 22, 2012

Related U.S. Application Data

(63) Continuation-in-part of application No. PCT/BE2010/000036, filed on Apr. 30, 2010.

(30) Foreign Application Priority Data

May 5, 2009 (EP) ..... 09447019

(51) Int. Cl.
*A47G 21/18* (2006.01)

(52) U.S. Cl.
CPC ..... *A47G 21/18* (2013.01)
USPC ..... 239/33; 273/139

(58) Field of Classification Search
CPC ... A47G 21/18; A47G 21/182; A47G 21/185; A61J 15/00
USPC ..... 239/12, 33; 273/138.1, 139; 220/705, 220/711–713; 215/228, 229, 388
See application file for complete search history.

(56) References Cited

U.S. PATENT DOCUMENTS

| | | | | |
|---|---|---|---|---|
| 2,094,268 | A | 9/1937 | Friedman | |
| 2,811,808 | A * | 11/1957 | Briese | 446/72 |
| 4,298,475 | A | 11/1981 | Gartner | |
| 5,048,709 | A | 9/1991 | Alverson | |
| 5,076,433 | A * | 12/1991 | Howes | 206/459.5 |
| 5,785,171 | A * | 7/1998 | Howes | 206/232 |
| 5,957,279 | A * | 9/1999 | Howes | 206/232 |
| 6,565,899 | B1 | 5/2003 | Cecere | |
| 2006/0144955 | A1 | 7/2006 | Farnsworth et al. | |
| 2008/0173610 | A1 * | 7/2008 | Esposito | 215/227 |

FOREIGN PATENT DOCUMENTS

| | | |
|---|---|---|
| CN | 2764256 | 3/2006 |
| EP | 1095600 A1 | 5/2001 |
| JP | 60121881 | 8/1985 |
| JP | 2001258713 A | 9/2001 |
| WO | 99/01359 A1 | 1/1999 |

OTHER PUBLICATIONS

International Search Report WO 2010/127416 A3 of prior application PCTBE2010/000036, completed Nov. 30, 2010 and mailed Dec. 8, 2010.

Written Opinion of the International Searching Authority of International Application No. PCTBE2010/000036, completed Nov. 30, 2010 and mailed Dec. 8, 2010.

* cited by examiner

*Primary Examiner* — Darren W Gorman
(74) *Attorney, Agent, or Firm* — Hovey Williams LLP

(57) ABSTRACT

A cap for a drinking straw preferably includes a container provided with an inner chamber and with an element to be torn from one of the wall of the container for enabling access within the chamber, and a body attached to the container and provided with a portion adapted to enter at least partly within the drinking channel, whereby the body is adapted so as to form an air passage between the drinking channel and the gas atmosphere when the body extends within the drinking straw.

33 Claims, 8 Drawing Sheets

Fig 1
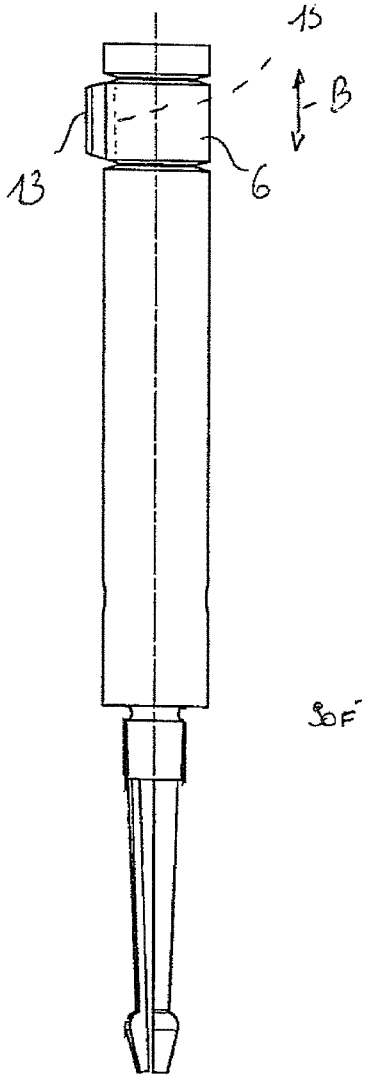
Fig 2
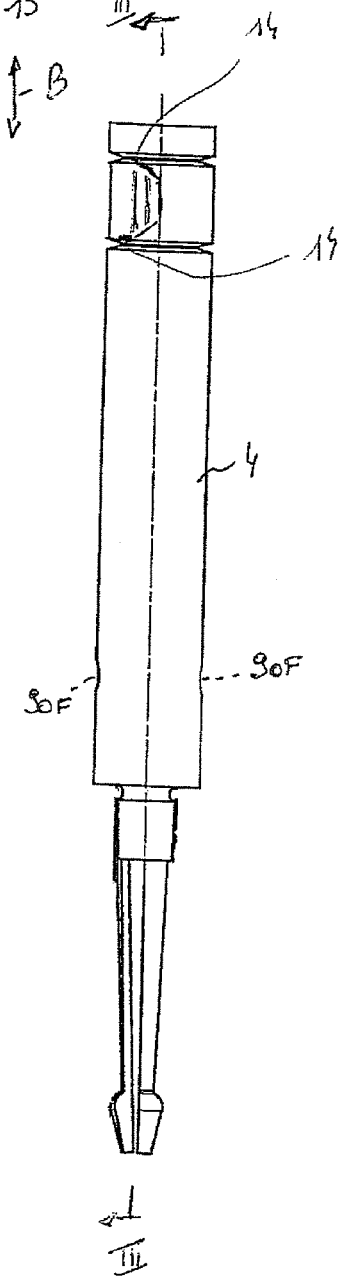
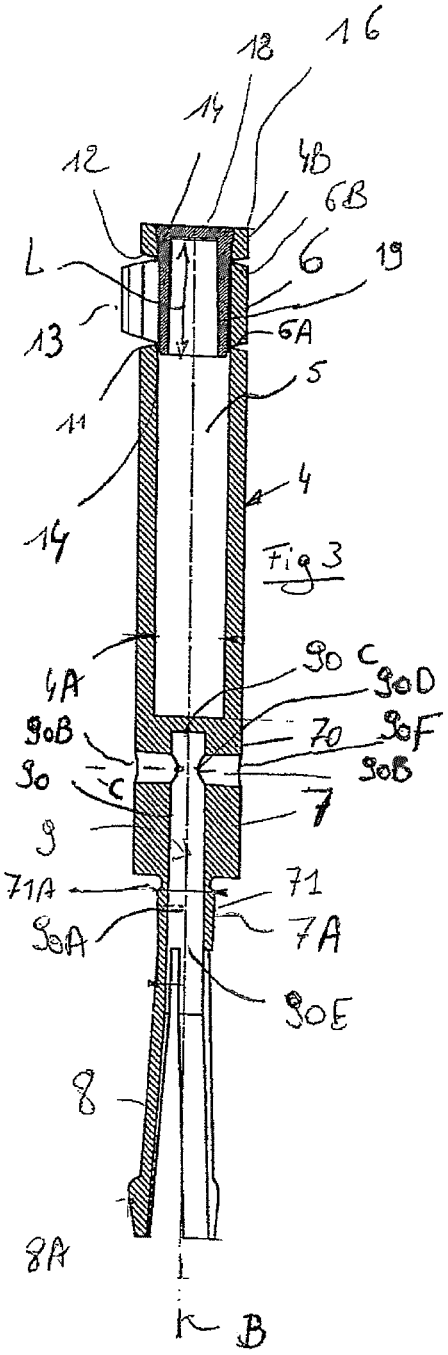
Fig 3

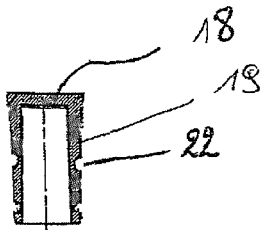
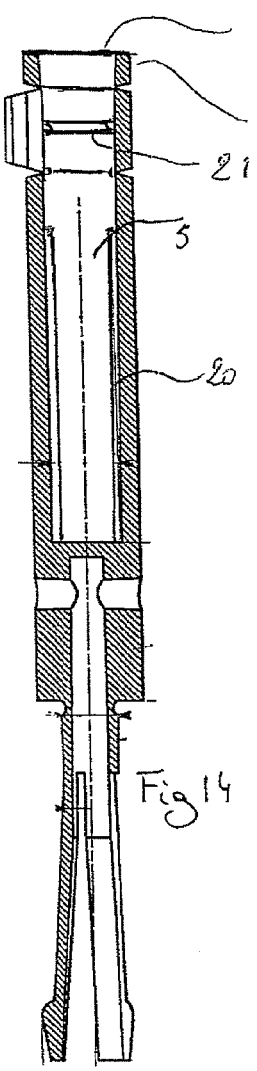
Fig 14
Fig 15
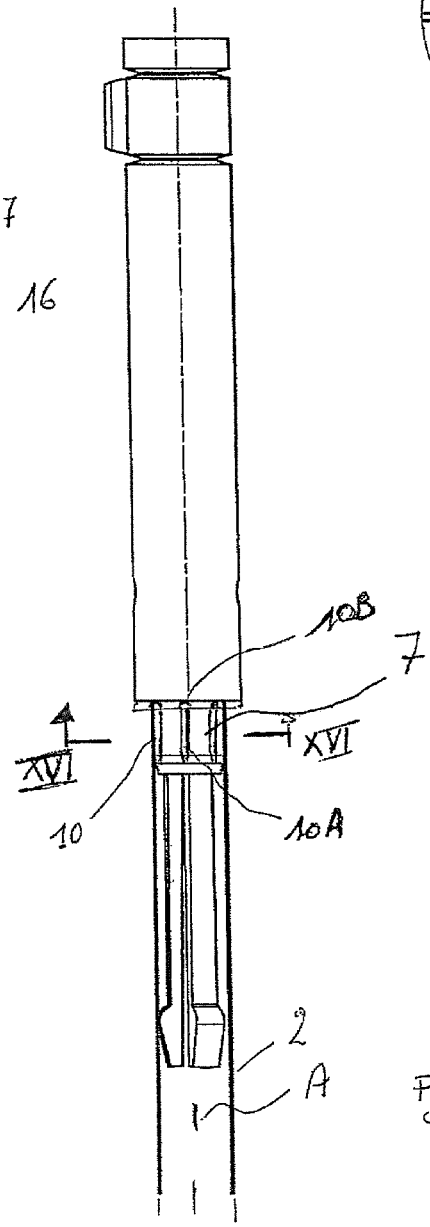
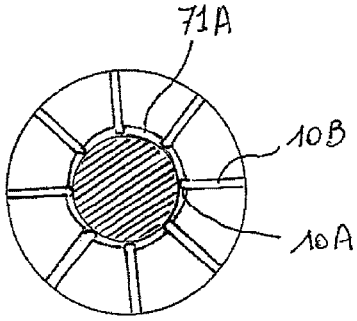
Fig 16
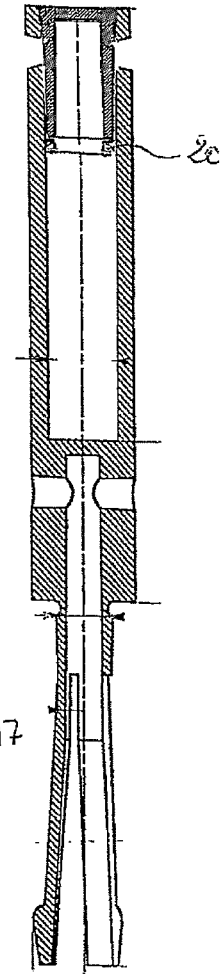
Fig 17

CAP FOR A DRINKING STRAW

CROSS REFERENCE TO RELATED APPLICATIONS

The present application is a continuation in part of International Application No. PCT/BE2010/000036 filed on 30 Apr. 2010 designating the United States and published under number WO2010/127416 on Nov. 11, 2010, said application claiming the benefit of the priority of European Patent Application EP 09 447 019.2 filed on May 5, 2009, the entire disclosures of which are incorporated herein by reference.

BACKGROUND OF THE INVENTION

1. Field of the Invention

The invention relates to a cap for a drinking straw. The cap includes a container provided with an inner chamber and with an element to be torn from one of the wall of the container for enabling access within the chamber, and a body attached to the container and provided with a portion adapted to enter at least partly within the drinking channel, whereby the body is adapted so as to form an air passage between the drinking channel and the gas atmosphere when the said body extends within the drinking straw. The present invention also relates to a cap for a drinking straw, the cap being provided with a container suitable for receiving an article, such as a diamond, a prize, etc. The straws provided with the caps can then be randomly be distributed so that one or more persons randomly chosen receive(s) one article or different articles, for example a high value prize award article for one or more persons, and a low value prize award for one or more other persons.

2. Brief Description of the Prior Art

Drinking straws are well known in the art. The straws have generally a substantially circular cross-section. In order to facilitate the bending of a portion thereof with respect to another portion, it is well known to provide the straw with several corrugations so as to form a intermediate flexible portion between two linear portions of the straw (see U.S. Pat. No. 2,094,268—Friedman).

EP1095600 discloses a straw provided with a cap with lateral openings, said cap being able to slide along the straw between a closed position in which the lateral openings of the cap are laying along the outer face of the straw (position not allowing to suck liquid through the straw), and an open position in which the openings of the cap extend above the upper end of the straw, whereby enabling to suck liquid through the cap. The straw is provided with a protuberance for limiting the movement of the cap with respect to the straw, i.e. for preventing the complete removal of the cap from the straw.

CN2764256 discloses a cap covering the end and outer face of the straw, the cap is provided with a small opening at the top of the cap. The bottom of the cap is provided with a plate.

JP2001-258713 discloses a cap for a straw, said cap being connected to a ring via a flexible band, said ring being adapted to be mounted along the straw, so as to remain near the end of the straw when opened.

U.S. Pat. No. 6,565,899 discloses a drinking straw closed with a cap provided with a lollipop.

US20066144955 discloses a drinking straw provided with a pump combined display area and prize delivery system, said pump being located between the two ends of the straws.

PCT/US98/12897 discloses in FIG. 3 a straw constructed with an independent container 30 constructed for insertion within the straw. The prize, such as a US currency, will be rolled and inserted in the container, said container being associated with a cap or cover. The straw with container is placed within a outer protective closure/container 23. The user has first to remove the straw from its outer protective closure before being able to use its straw. The outer protective closure forms the system for indicating whether or not a container has possibly be opened. Furthermore, as long as the container is placed within the straw, it has been observed that the straw (taken away from its protective enclosure) placed in a drinking glass containing a drinking liquid, especially a sparkling liquid or a bubbling liquid had the tendency to move upwardly, whereby being at risk to fall or pivot away from the glass.

SUMMARY OF THE INVENTION

The present invention has for subject matter a cap having a recipient intended to contain an article or a prize or an award, the opening or re-closing of which is visible for the person receiving a straw provided with a cap, whereby said person can easily determine whether the container has been opened by people wanting to know by advance which cap comprises a winning article, award or prize, said cap being moreover adapted to be mounted on a straw used in a drinking glass containing a sparkling liquid, without risk for the straw to pivot around an edge of the glass and to fall.

Advantageously, the cap of the invention comprises a container which when opened is divided into three parts, namely a first container part, a second container part, and an intermediate part, whereby the first container part and the second container part can be associated together for forming a new closed container having a volume or a shape or a colour at least partly different from the initial volume or shape of the container before its opening. It enables thus, after opening the initial container and checking the article or prize within the container chamber, to replace the article or price within a part of the chamber and to close it back with another part of the container. After replacing the closing of the article, the shape of the container will be reduced, whereby showing quickly whether or not the container has been opened when giving a drinking glass with a straw provided with a cap.

The invention relates to a cap for a drinking channel of a drinking straw for drinking a liquid contained in a recipient placed in an air atmosphere, said cap being removably mounted with respect to an upper end of the drinking channel of the drinking straw, said cap comprising:

a container provided with at least one wall defining a chamber adapted for receiving an article, and with an element to be torn at least partly from one of said wall for enabling to have access to the article present within the chamber, possibly after removal of a sealing means, a body having one end attached to the container or part thereof and another end provided with a portion having an outer shape adapted to enter at least partly within the drinking channel through said upper end of the straw, the said body comprising at least one flexible element adapted to exert a pressure on the wall(s) of the drinking straw when the said portion of the body extends at least partly within the drinking channel, whereby the body is adapted so as to form with the drinking channel at least one air passage between the drinking channel and the gas atmosphere when the said portion extends at least partly within the drinking channel and/or comprises means for defining at least one air passage between the drinking channel and the gas atmosphere when the said portion extends at least partly within the drinking channel.

As used in the present specification:

drinking straws mean straws suitable to be used for the consumption of drinks, such as alcoholic and non alcoholic drinks, such as sparkling wine, champagne, etc., the shape of the drinking straws is longitudinal with or without one or more flexible, bendable or corrugated portion, with a cross-section which is circular, oval, square, rectangular, etc. or a combination thereof. The drinking straw can be provided with additional pumping system.

container means an element or a part of an element having an inner chamber, which is preferably completely closed before the tearing of the band. The inner chamber can have various shapes, but the shape thereof is preferably elongated, preferably cylindrical. The closed container consists advantageously of two pieces, namely a body with an opening for enabling to introduce an article, prize or award within the chamber, and a closing element adapted to close the opening in such a way that when the closing element is pushed within the opening, said closing element being well secured onto the body and can possibly be removed after tearing of the band.

cap means an element for closing at least partly the upper end of the straws, said cap is advantageously made by injection, preferably plastic injection. The cap can also be manufactured, in part or completely, in other materials, such as paper (for example by winding paper film, cellulose based composition, cardboard, biodegradable material, etc. The cap can be formed in one, two or three pieces, preferably in two pieces. For example, the cap can be formed in one single piece, whereby a award, prize or article (possibly within an envelope) is placed within a recess of an injection mould, before injecting the plastic for producing the cap. The cap can be formed in two pieces, namely a portion with an open container, and a closing element, whereby the article, prize or award is placed within the open container, which is then closed by the closing element.

The cap can also be made in three parts, for example a container with an open end, a closing element for sealing the opening, and a body with at least a portion adapted to be inserted within the drinking channel, whereby the body and the container or the closing element can be fixed together, for example by clipping. The cap can be associated with one or several objects, such as figurines, miniatures, models, etc.

According to an embodiment, "cap" means also a container provided with a means adapted to be associated to a product, a food or a non food product, especially a food, such as food individual portions, food cubes, cheese products, ice creams, desert, lobster, steak, potatoes, meals, lambs, liquids, etc. For example, the said means is adapted for facilitating the eating of food portions by pricking into said food portion, for facilitating the mixing or stirring of liquids, such as liquids contained within a glass. According a possible embodiment, the said means is in the form of a spoon, a cutting means, a fork, a stick.

The means adapted to be associated to a non food product can be for example a pin adapted to attach the cap onto a cloth, a ring or a clip, such as an ear clip.

"article" means a promotional article, a promotional vehicle, an award, a prize, a ticket, a piece of paper with one or more numbers/letters, stones, such as diamond stones, winning article, non winning articles, coupon elements, non prizing element, coupons for a new drink, cash awards, messages, jokes, phone numbers, seat numbers, etc., as well as perfume, food additives, salts, spice, food dressing, sugar, aspartam, powders, milk powder, cacao powder, etc. Advantageously, caps from some straws are provided with winning article or high prize article or winning coupon, while other caps for some other straws are provided with non winning article or low prize article or not winning coupon, whereby the weight of a cap with a winning article is substantially equal, preferably equal to the weight of a cap with a non-winning article.

"randomly distributed" means that employees distributing caps, straws provided with caps, food containers or drinking containers associated or provided with a straw provided with a cap, drinking glasses provided with a straw bearing a cap are unable to know, without opening of the container of the cap, whether the container cap is containing a winning article or a non winning article or the type of message or the type of article present with the container of the cap.

"air passage" means one or more passages allowing air, as well as other gases, such as $CO_2$ to flow from the drinking channel of the straw towards the outer or room atmosphere, and inversely.

In the cap of the invention, the air passage or at least one air passage will be advantageously adapted for enabling the passage of air, and for enabling the downwards flowing of the drinking liquid possibly present within the air passage. The air passage will also preferably be such that in case liquid is present within the air passage, air or $CO_2$ bubbles are able to percolate within the liquid possibly present within the air passage. The air passage(s) or at least one air passage has/have advantageously at least a minimum cross-section in which a circle with a diameter of at least 2 mm (preferably at least 3 mm, preferably from 3 to 7 mm) can be drawn.

According to an advantageous embodiment, the element to be torn is a band of the container wall(s) extending between a first container portion and a second container portion, whereby said band is adapted when torn from the container wall(s) for allowing at least a relative motion between the first and second container portions, preferably a take away motion between the first container portion and the second container portion. Said band extends advantageously between two grooves or lines with a series of cuts or perforations, for guiding the tearing operation. The band is preferably associated with an extension for facilitating the gripping of the band and its tearing. According to an advantageous detail, the end of the band to be first torn is provided with two cuts (the end of the band extending between said two cuts) for facilitating the start of the tearing operation or for reducing the initial tearing force.

Preferably, the band of the container to be torn from the container wall(s) for enabling for a relative motion between the first container portion and the second container portion is adapted to be taken away at least from one container portion, advantageously from the first and second container portions.

According to an embodiment, the cap comprises a container having a first container portion, a second container portion, and a band connecting the first and second container portion when said band is not torn, and adapted for enabling a relative motion between said first and second container portion when torn, whereby the first container portion and/or the second container portion is/are provided with at least one means adapted to be secured on the first container portion or on the second container portion, so as to form a reduced closed container with a inner volume lower than the volume of the closed container before the tearing off of the band. The band extends advantageously between the first container portion and the second container portion, whereby after tearing completely the band, the first and second container portions are separate from each other.

Preferably, the first container portion defining a first container volume is attached to the body, while the second container portion is adapted to be moved away from the first container portion after tearing off the band from the container wall(s), whereby the second portion is provided with means adapted to enter at least partly within the first container volume of the first container so as to close at least partly the first container portion.

According to a detail of an embodiment, the second container portion comprises at least two distinct parts:

(a) a support with an opening and defining a support volume, and (b) a closing element adapted to close the said opening when pushed on said support, whereby the closing element has at least one means having an end extending outside said support volume and adapted for entering at least partly into the first container volume so as connect, in a releasable manner, the second container portion onto the first container portion.

Preferably, the closing element may be adapted to work with the support and/or the band adapted to be torn, when pushed through the opening of the support of the second container portion and when the band is not torn, for blocking the closing element and preventing its withdrawal from the container.

Most preferably, the closing element comprises a skirt provided along its outer face, with at least one groove or protuberance, while the band to be torn is provided, on its face directed towards the chamber of the container, with at least one groove or protuberance, whereby the protuberance of the skirt is adapted to enter with the groove of the band or to abut against the protuberance of the band for preventing the removal of the closing element at least as long as the band is not torn or whereby the groove of the skirt is adapted to receive a protuberance of the band to be torn for preventing the removal of the closing element at least as long as the band is not torn.

According to a detail of further embodiments, the body comprises at least two legs adapted to enter at least partly within the drinking channel through said upper end of the straw, at least one of said leg is flexible, whereby the said legs are each provided with a protuberance adapted to contact the inner wall of the straw when said legs enter within the drinking channel.

Preferably, for a cap for a straw having a drinking channel with a portion adjacent to the upper end with a central axis and a substantially circular cross section having a diameter, the body comprises three legs, the protuberance of said legs laying along an outer circle with a diameter greater than the diameter of the portion of the straw adjacent to the upper end. More specifically, the protuberance of said legs laying along an outer circle with a diameter is comprised between 1.2 and 2 times, advantageously between 1.5 and 1.9 times the diameter of the portion of the straw adjacent to the upper end.

According to still a further possible embodiment, the body may be provided with at least one leg one or more leg with at least one portion forming a spiral or adapted to form a spiral after deformation. The portion is advantageously flexible, so as to enable a screwing like movement of the cap on the end of the straw.

According to still a further detail of a possible embodiment, the body may be provided with one or more thread portions or thread(s) on its outer face to be directed towards the inner face of the straw when the body is inserted within the straw.

According to a still possible embodiment, one or more legs or the body can comprises a pin shaped element so as to enable to prick the cap on a support, for example food, individual food portions.

According to still a further embodiment, the leg or legs of the body may be adapted for being pricked into a soft support, so as to facilitate the presentation of the caps before their use by invited peoples.

According to advantageous embodiments, the body comprises:

(a) a first body portion attached or connected to the container, and (b) a second body portion adapted to enter within the drinking channel, whereby the means for forming the air passage between the drinking channel and the gas atmosphere when said second body portion extends within the drinking channel comprises at least an air channel extending in the first body portion. Preferably, the second body portion comprises a tube connected to the first body portion and at least two legs, one of which is at least partly flexible, whereby the means for forming the air passage between the drinking channel and the gas atmosphere when said second body portion extends within the drinking channel comprises at least an air channel extending in the first body portion and the said tube.

Advantageously, the first body portion may have a lateral face, whereby the air channel extending in the first body portion has at least one opening, advantageously at least two openings along the lateral side of the first body portion.

According to a further advantageous detail, the air channel extending into the first body portion comprises:

(a) a first channel portion extending between an opening directed towards the drinking channel when the said second body portion extends within the drinking channel of the straw, and an upper closed end directed towards the container, and (b) a second channel portion extending between an opening located between the upper closed end and the opening of the first channel portion, and an opening located along the lateral face of the first body portion.

Preferably, the air channel comprises at least two second channel portions, each of said second channel portion extending between an opening located between the upper closed end and the opening of the first channel portion, and an opening located along the lateral face of the first body portion, whereby each of the said two second channel portions is a substantially rectilinear channel with a central axis, whereby an angle is formed between the central axis of said two second channel portions, said angle being comprised between 90° and 270°, advantageously between 120° and 240°, preferably being about 180°.

According to a still further detail of advantageous embodiment, the air passage between the drinking channel and the gas atmosphere may have a diameter adapted for enabling the natural flowing of drinking liquid, in case drinking liquid would enter within the said air passage.

The cap of the invention can be sold, with or without the article, award, prize, i.e. with the container of one or more caps provided with an article, award, prize, or with the container in open form without tearing the band or in a form adapted to be opened without tearing of the band (the closing means being not pushed in a position in which it can only be taken away after breaking or tearing the band), so as to enable an user to fill him self the container, before randomly distributing the caps advantageously mounted on drinking straws.

The invention thus also relates to drinking straws provided with a cap of the invention, as disclosed here above.

The invention relates also to a method for delivering at least one article or at least two different articles in a randomly way by distributing to several persons caps according to the invention or drinking straws provided with a cap according to the invention, preferably a cap with a container provided with a closing element.

The drinking straws are advantageously distributed with a drinking glass, bottle or container.

The method advantageously comprises the following steps:

providing a series of caps already provided with articles within their chamber, or providing a series of caps for which the second container portion comprises at least two distinct parts:

(a) a support with an opening and defining a support inner volume, and (b) a closing element adapted to close the said opening when pushed on said support, wherein the closing element has preferably at least one means having an end extending outside said support inner volume and adapted for entering at least partly into the first container volume so as connect, in a releasable manner, the second container portion onto the first container portion, with the closing element away from the support of the second container portion so that the opening of the support forms an opening for the container chamber, for the caps for which the second container portion comprises at least two distinct parts:

(a) a support with an opening and defining a support inner volume, and (b) a closing element adapted to close the said opening when pushed on said support, wherein the closing element has preferably at least one means having an end extending outside said support inner volume and adapted for entering at least partly into the first container volume so as connect, in a releasable manner, the second container portion onto the first container portion, introducing at least one article through the opening of the support into the chamber in one or more caps or introducing one article through the opening of the support into the chamber in some caps and introducing another article through the opening of the support into the chamber in some other caps, and closing the opening of the support of the second container portion of the caps by pushing closing element into the opening of the support of said caps, before or after associating the caps with drinking straws;

randomly distributing the caps or the drinking straws with closed caps, advantageously with drinking glasses, bottles, containers to people, whereby each person receiving a cap or a drinking straw provided with a closed cap, possibly after removing the cap from the drinking straw, has to tear the band so as to have access to the chamber of the container, so as to collect the article possibly present within the chamber of the cap.

The method of the invention may preferably comprise the following steps:

providing a series of caps, with the closing element away from the support of the second container portion so that the opening of the support forms an opening for the container chamber, introducing at least one article through the opening of the support into the chamber in one or more caps or introducing one article through the opening of the support into the chamber in some caps and introducing another article through the opening of the support into the chamber in some other caps, closing the opening of the support of the second container portion of the caps by pushing closing element into the opening of the support of said caps, before or after associating the caps with drinking straws;

randomly distributing the drinking straws with closed caps, advantageously with drinking glasses to people, whereby each person receiving a drinking straw provided with a closed cap, possibly after removing the cap from the drinking straw, has to tear the band so as to have access to the chamber of the container, so as to collect the article possibly present within the chamber of the cap.

Specific methods according to the invention are or may include:

A. a method for delivering at least one article in a randomly way by distributing to several persons drinking straws provided with a cap, in which the drinking straws have a drinking channel for drinking a liquid contained in a recipient placed in an air atmosphere, said drinking straw being provided with a cap adapted to be mounted removable with respect to an upper end of the drinking channel of the drinking straw, in which said cap comprises:

a container provided with at least one wall defining a chamber adapted for receiving an article, and with an element to be torn at least partly from one of said wall for enabling to have access to the article present within the chamber, a body having one end attached to the container or part thereof and another end provided with a portion having an outer shape adapted to enter at least partly within the drinking channel through said upper end of the straw, the said body comprising at least one flexible element adapted to exert a pressure on a wall of the drinking straw when the said portion of the body extends at least partly within the drinking channel, wherein the body is selected form the group consisting of (a) a body having a shape adapted to form with the drinking channel at least one air passage between the drinking channel and the gas atmosphere when the said portion extends at least partly within the drinking channel, (b) a body comprising means for defining at least one air passage between the drinking channel and the gas atmosphere when the said portion extends at least partly within the drinking channel, and (c) a body having a shape adapted to form with the drinking channel at least one first air passage between the drinking channel and the gas atmosphere when the said portion extends at least partly within the drinking channel, said body further comprising means for defining at least one second air passage between the drinking channel and the gas atmosphere when the said portion extends at least partly within the drinking channel, said method comprising the following steps:

providing a series of caps, at least one of which being provided with an article within its chamber, associating the caps with drinking straws, randomly distributing the drinking straws with a closed cap to the persons, tearing off the band of the closed cap by each person receiving a drinking straw provided with a closed cap, so that each person has access to the chamber of the container.

Advantageously, said method A is adapted for delivering at least one first article through one closed cap and at least one series of second articles different from said first article, in a randomly way by distributing to several persons drinking straws provided each with a closed cap adapted to be mounted removable with respect to an upper end of the drinking channel of the drinking straw, in which said cap comprises:

a container provided with at least one wall defining a chamber adapted for receiving an article, and with an element to be torn at least partly from one of said wall for enabling to have access to the article present within the chamber, a body having one end attached to the container or part thereof and another end provided with a portion having an outer shape adapted to enter at least partly within the drinking channel through said upper end of the straw, the said body comprising at least one flexible element adapted to exert a pressure on a wall of the drinking straw when the said portion of the body extends at least partly within the drinking channel, wherein the body is selected form the group consisting of (a) a body having a shape adapted to form with the drinking channel at least one air passage between the drinking channel and the gas atmosphere when the said portion extends at least partly within the drinking channel, (b) a body comprising means for defining at least one air passage between the drinking channel and the gas atmosphere when the said portion extends at least partly within the drinking channel, and (c) a body having a shape adapted to form with the drinking channel at least one first air passage between the drinking channel and the gas atmosphere when the said portion extends at least partly within the drinking channel, said body further comprising means for defining at least one second air passage between the drinking channel and the gas atmosphere when the said portion extends at least partly within the drinking channel.

B. a method for delivering at least one article in a randomly way by distributing to several persons drinking straws provided with a cap, in which the drinking straws have a drinking channel for drinking a liquid contained in a recipient placed in an air atmosphere, said drinking straw being provided with a cap adapted to be mounted removable with respect to an upper end of the drinking channel of the drinking straw, in which said cap comprises:

a container provided with at least one wall defining a chamber adapted for receiving an article, and with an element to be torn at least partly from one of said wall for enabling to have access to the article present within the chamber, a body having one end attached to the container or part thereof and another end provided with a portion having an outer shape adapted to enter at least partly within the drinking channel through said upper end of the straw, the said body comprising at least one flexible element adapted to exert a pressure on a wall of the drinking straw when the said portion of the body extends at least partly within the drinking channel, wherein the body is selected form the group consisting of (a) a body having a shape adapted to form with the drinking channel at least one air passage between the drinking channel and the gas atmosphere when the said portion extends at least partly within the drinking channel, (b) a body comprising means for defining at least one air passage between the drinking channel and the gas atmosphere when the said portion extends at least partly within the drinking channel, and (c) a body having a shape adapted to form with the drinking channel at least one first air passage between the drinking channel and the gas atmosphere when the said portion extends at least partly within the drinking channel, said body further comprising means for defining at least one second air passage between the drinking channel and the gas atmosphere when the said portion extends at least partly within the drinking channel, and in which the second container portion comprises at least two distinct parts:

(a) a support with an opening and defining a support inner volume, and (b) a closing element adapted to close the said opening when pushed on said support, said method comprising the following steps:

providing a series of caps with the closing element not closing the opening of the support of said second container portion;

introducing at least one article through the opening of the support into the chamber of at least one cap, for the caps with the closing element not closing the opening of the support of said second container portion, pushing the closing element into said opening so as to close the chamber of said caps, associating the caps with drinking straws, randomly distributing the drinking straws with a closed cap to the persons, tearing off the band of the closed cap by each person receiving a drinking straw provided with a closed cap, so that each person has access to the chamber of the container.

Advantageously, said method B is adapted for delivering at least one first article through one closed cap and at least one series of second articles different from said first article, in a randomly way by distributing to several persons drinking straws provided each with a closed cap adapted to be mounted removable with respect to an upper end of the drinking channel of the drinking straw, in which said cap comprises:

a container provided with at least one wall defining a chamber adapted for receiving an article, and with an element to be torn at least partly from one of said wall for enabling to have access to the article present within the chamber, a body having one end attached to the container or part thereof and another end provided with a portion having an outer shape adapted to enter at least partly within the drinking channel through said upper end of the straw, the said body comprising at least one flexible element adapted to exert a pressure on a wall of the drinking straw when the said portion of the body extends at least partly within the drinking channel, wherein the body is selected form the group consisting of (a) a body having a shape adapted to form with the drinking channel at least one air passage between the drinking channel and the gas atmosphere when the said portion extends at least partly within the drinking channel, (b) a body comprising means for defining at least one air passage between the drinking channel and the gas atmosphere when the said portion extends at least partly within the drinking channel, and (c) a body having a shape adapted to form with the drinking channel at least one first air passage between the drinking channel and the gas atmosphere when the said portion extends at least partly within the drinking channel, said body further comprising means for defining at least one second air passage between the drinking channel and the gas atmosphere when the said portion extends at least partly within the drinking channel, and in which the second container portion comprises at least two distinct parts:

(a) a support with an opening and defining a support inner volume, and (b) a closing element adapted to close the said opening when pushed on said support, said method comprising the following steps:

providing a series of caps with the closing element not closing the opening of the support of said second container portion;

introducing at least one first article through the opening of the support into the chamber of at least one first cap and second article through the opening o the support into the chamber of a series of second caps, said second article being different from the first article;

for the caps with the closing element not closing the opening of the support of said second container portion, pushing the closing element into said opening so as to close the chamber of said caps, associating the caps with drinking straws, randomly distributing the drinking straws with a closed cap to the persons, tearing off the band of the closed cap by each person receiving a drinking straw provided with a closed cap, so that each person has access to the chamber of the container.

According to a further detail of method B using caps in which the second container portion comprises at least two distinct parts:

(a) a support with an opening and defining a support inner volume, and (b) a closing element adapted to close the said opening when pushed on said support, wherein the closing element has at least one means having an end extending outside said support inner volume and adapted for entering at least partly into the first container volume so as connect, in a releasable manner, the second container portion onto the first container portion, said method comprises the following steps:

providing a series of caps with the closing element not closing the opening of the support of said second container portion;

introducing at least one first article through the opening of the support into the chamber of at least one first cap and second article through the opening o the support into the chamber of a series of second caps, said second article being different from the first article;

for the caps with the closing element not closing the opening of the support of said second container portion, pushing the closing element into said opening so as to close the chamber of said caps, associating the caps with drinking straws, randomly distributing the drinking straws with a closed cap to the persons, tearing off the band of the closed cap by each person receiving a drinking straw provided with a closed cap, so that each person has access to the chamber of the container, for each open cap, connecting back the second container portion onto the first container portion, by pushing the end extending outside the support inner volume at least partly into the first container volume.

These methods can be used by industry for promoting one or another products, for example champagne, perfumes, etc. and by organisation or private people for animating a party. As external analysis of the caps will not permit the consumers or employees to discover winning caps from non-winning caps, whereby enabling a randomly distribution of the caps, or straws provided with caps, or drinking glasses with said straws.

By distributing such straws provided with caps, the fun of the party will be increased.

When the wining article of some caps is a diamond, the non winning caps are advantageously provided with a stone within the container, so that the consumers and employees cannot determine whether the container comprises a diamond or a piece of glass.

The invention further relates to a cap adapted to be associated to a product or a support, especially to food products, such as a served food, food individual portions, food cubes, cheese products, ice creams, desert, a lobster, steak, potatoes, meals, lambs, etc. for facilitating the eating of said food or for creating some fun and surprise with the food or meal, said cap comprising:

a container provided with at least one wall defining a chamber adapted for receiving an article, and with an element to be torn at least partly from one of said wall for enabling to have access to the article present within the chamber, possibly after removal of a sealing means, a body having one end attached to the container or part thereof and another end provided with a means adapted to connect or attach the cap to the said product, such a means being advantageously a portion having a pin like shape adapted to enter or prick into the food for facilitating the individual eating of said food.

The cap with the body with the said means or pin like shape portion has one or more of the following characteristics:

the element to be torn is a band of the container wall(s) extending between a first container portion and a second container portion, whereby said band is adapted when torn from the container wall(s) for allowing at least a relative motion between the first and second container portions, preferably a take away motion between the first container portion and the second container portion; and/or the band of the container to be torn from the container wall(s) for enabling for a relative motion between the first container portion and the second container portion is adapted to be taken away at least from one container portion, advantageously from the first and second container portions; and/or the cap comprises a container having a first container portion, a second container portion, and a band connecting the first and second container portion when said band is not torn, and adapted for enabling a relative motion between said first and second container portion when torn, whereby the first container portion and/or the second container portion is/are provided with at least one means adapted to be secured on the first container portion or on the second container portion, so as to form a reduced closed container with a inner volume lower than the volume of the closed container before the tearing off of the band; and/or the first container portion defining a first container volume is attached to the body, while the second container portion is adapted to be moved away from the first container portion after tearing off the band from the container wall(s), whereby the second portion is provided with means adapted to enter at least partly within the first container volume of the first container so as to close at least partly the first container portion; and/or the second container portion comprises at least two distinct parts:

(a) a support with an opening and defining a support volume, and (b) a closing element adapted to close the said opening when pushed on said support, whereby the closing element has at least one means having an end extending outside said support volume and adapted for entering at least partly into the first container volume so as connect, in a releasable manner, the second container portion onto the first container portion, and/or the closing element is adapted to work with the support and/or the band adapted to be torn, when pushed through the opening of the support of the second container portion and when the band is not torn, for blocking the closing element and preventing its withdrawal from the container; and/or the closing element comprises a skirt provided along its outer face, with at least one groove or protuberance, while the band to be torn is provided, on its face directed towards the chamber of the container, with at least one groove or protuberance, whereby the protuberance of the skirt is adapted to enter with the groove of the band or to abut against the protuberance of the band for preventing the removal of the closing element at least as long as the band is not torn or whereby the groove of the skirt is adapted to receive a protuberance of the band to be torn for preventing the removal of the closing element at least as long as the band is not torn; and/or the body is provided with an air channel.

The invention further relates to a method for delivering at least one article or at least two different articles in a randomly way by distributing to several persons caps adapted to be associated to a product as disclosed hereabove, especially to food products, such as caps pricked on a support or on different supports, such as individual food portions, said method comprising the following steps:

providing a series of caps already provided with articles within their chamber, or providing a series of caps, with the closing element away from the support of the second container portion so that the opening of the support forms an opening for the container chamber, for the caps with the closing element away from the support of the second container portion, introducing at least one article through the opening of the support into the chamber in one or more caps or introducing one article through the opening of the support into the chamber in some caps and introducing another article through the opening of the support into the chamber in some other caps, and closing the opening of the support of the second container portion of the caps by pushing closing element into the opening of the support of said caps;

randomly distributing the caps with closed caps, advantageously with food portions, whereby each person receiving a cap (preferably for enabling to take some food portions) or a food provided with a closed cap, possibly after removing the cap from the food, has to tear the band so as to have access to the chamber of the container, so as to collect the article possibly present within the chamber of the cap.

Details and characteristics of preferred embodiments will be disclosed in the following description, in which reference is made to the attached drawings of preferred embodiments.

BRIEF DESCRIPTION OF THE DRAWINGS

In these drawings,

FIG. 1 is a side elevation view of a first embodiment of a cap of the invention with a tearing band FIG. 2 is another side elevation view of the first embodiment oriented 90° to the side view of FIG. 1;

FIG. 3 is a cross section view of the first embodiment taken along the line III-III in FIG. 2;

FIG. 14 is an exploded cross section view of an embodiment similar to the embodiment of FIG. 3, but prior the closing of the container with a sealing member;

FIG. 15 is a side elevation view of another embodiment similar to the embodiment of FIG. 1;

FIG. 16 is an enlarged cross section view taken along the line XVI-XVI of FIG. 15 of the embodiment of FIG. 15;

FIG. 17 is a cross section view of an additional embodiment similar to that shown in FIG. 8, but with abutment for limiting the insertion of the second container portion into the first container portion.

DESCRIPTION OF PREFERRED EMBODIMENTS

Figure 9:
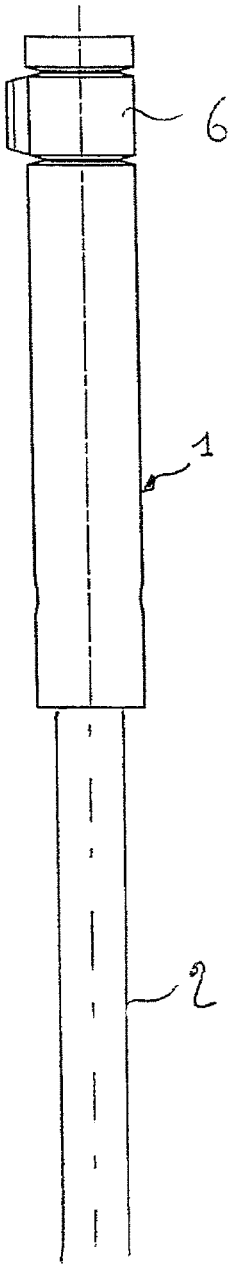
FIG. 9 is a side elevation view of the first embodiment of the cap similar to FIG. 1 with the cap mounted on the upper end of a straw.
Figure 10:
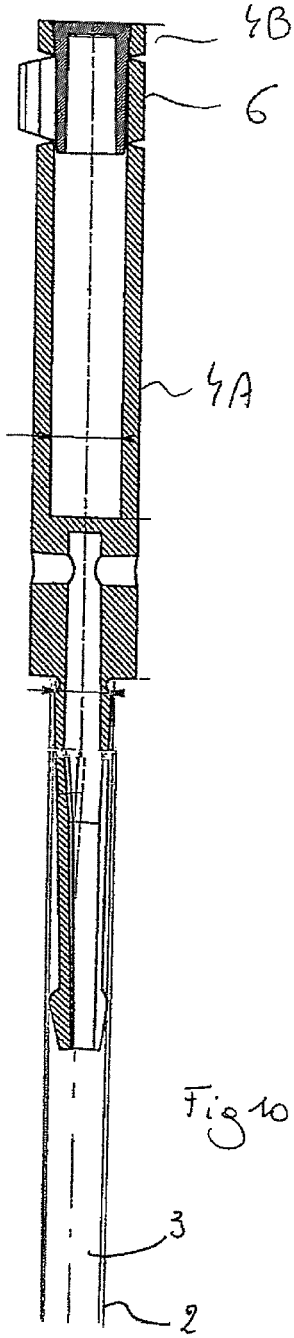
FIG. 10 is a cross section view of the cap and straw of FIG. 9.

FIG. 1 shows a cap 1 for a drinking channel of a drinking straw 2 for drinking a liquid contained in a recipient placed in an air atmosphere. FIG. 9 shows the cap 1 mounted on the end of the drinking straw 2. In fact legs of the cap 1 are inserted within the drinking channel 3 of the straw 2.

The cap 1 is mounted removable with respect to an upper end of the drinking channel of the drinking straw, whereby enabling its removal from the drinking straw so as to enable a normal use of the drinking straw.

The cap 1 comprises (see FIG. 3):

a container 4 provided with at least one wall defining a chamber 5 adapted for receiving an article (not shown), and with a band 6 to be torn from the container wall 4 for enabling to open the container 4 and to divide it into three parts, so as to have access to the article present within the chamber, possibly after removal of a sealing means, a body 7 having one end attached to the container 4 and another end provided with a portion 7A having an outer shape adapted to enter at least partly within the drinking channel 3 through said upper end of the straw 2.

The body 7 comprises three flexible legs 8 adapted to exert a pressure on the wall(s) of the drinking straw, preferably the inner wall of the drinking straw, when the said portion 7A of the body 7 extends at least partly within the drinking channel. The legs 8 extend advantageously within the drinking channel, so as not to deform the upper end of the drinking channel The body 7 is adapted so as to form with the drinking channel 3 at least one air passage 9 between the drinking channel 3 and the gas atmosphere when the body 7 extends at least partly within the drinking channel 3. Such an air passage enables that when the straw provided with a cap is placed in a drinking glass containing a liquid, such as a bubbling liquid, the bottom end of the straw remains in the vicinity of the bottom of the glass, i.e. the straw is not moving upwardly.

For ensuring air passage between the drinking channel 3 of the straw 2 and the outer gas atmosphere or air environment, the body 7 is provided with a series of grooves 10 comprising each a first portion (peripheral) 10A substantially parallel to the central axis A of the straw 2, and a second portion 10B substantially radial with respect to the central axis A of the straw 2. Said second radial portion of each groove 10 is intended to extend at least partly above the upper end of the straw 2, whereby the grooves 10 form air passage between the drinking channel 3 of the straw and the outer environment. Such air channels are shown in FIGS. 15 and 16. In the embodiment shown, the first peripheral portions 10A and the second radial portions 10B are communicated the one with the other by means of a circular groove 71A.

In the embodiment of FIG. 15, the body 7 is not provided with a central channel extending within the body as in the embodiment of FIG. 3.

According to a possible embodiment, the body 7 is provided with a central channel 9 as shown in FIG. 3, as well as outer grooves 10 as shown in FIGS. 15 and 16, whereby ensuring air passage between the body 7 and the straw 2, and trough the body 7.

Figure 5:
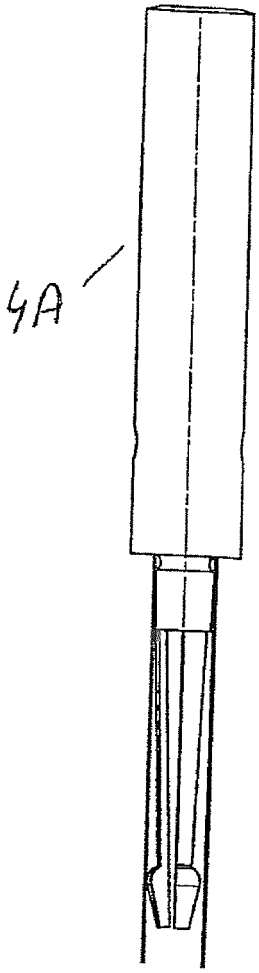
FIG. 5 is an exploded side view of the first embodiment after tearing the band.

The container 4 comprises a first container portion 4A and a second container portion 4B, said portions 4A,4B being connected through the band 6 before its tearing. For controlling the tearing of the band 6, a groove 11 extends between a first edge 6A of the band 6 and the first container portion 4A, while another groove 12 extends between the edge 6B (opposite to edge 6A) of the band 6 and the second container portion 4B. After tearing of the band 6, the second container portion 4B can be placed a side of the first container portion 4A (see FIG. 5), whereby enabling to have access to the chamber 5 of the container 4.

Figure 18:
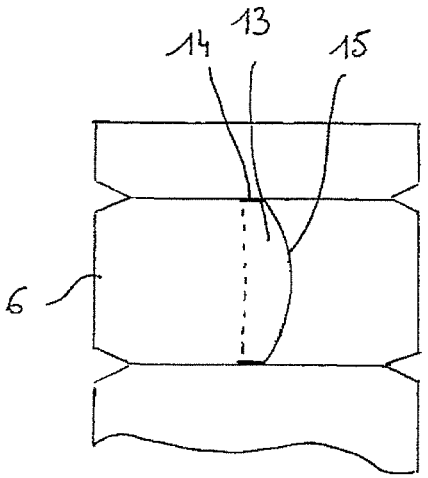
FIG. 18 is an enlarged detail view of the tearing band, before its tearing.

For facilitating the tearing of the band 6, the band 6 is provided with an extension part 13 at the end of the band to be the first to be torn. Said end of the band to be first torn is advantageously separated from the first container portion 4A and second container portion 4B by two cuts 14 for facilitating the initial tearing by decreasing the initial tearing force. For facilitating the initial tearing of the band 6, the end 6E of the band to be first torn (end 6E provided with the extension 13 for facilitating the gripping of the band by a finger or between two fingers) is separated from the container or the opposite end of the band by at least a cut 15 shown in dashed lines, said cut 15 being advantageously connected to the cuts 14 extending along the edges 6A,6B of the band 6. (see FIG. 18, in which the extension is partially cut)

After tearing the band 6 away, the container 4 is divided into a bottom portion 4A and a top portion 4B. The top portion 4B consists of a ring 16 with a central opening 17 (see FIG. 14) adapted to receive a plug 18 for sealing said opening 17. The plug 18 has a skirt 19 having a length L greater than the breadth B of the band 6. The length of the skirt 19 is advantageously such that, before the tearing of the band 6, at least a portion of the skirt 19 contacts the inner wall of the chamber 5 defined within the first container portion 4A. This enables that after tearing the band, the free end of the skirt 19 is still contacting the first container portion and remains attached to said first container portion. The second container portion can then be removed by exerting a simple pushing force. This system avoids also that after the tearing operation of the band 6, that the second container portion falls on the ground or within a glass.

After removal of the band 6 and opening of the first container portion by pushing away the second container portion 4B, it is possible to have access to the chamber 5 in order to collect the award or stone or other elements present in the chamber 5.

The chamber 5 can be closed back by pushing the second container portion 4B onto the first container portion, so that the skirt 19 of the plus of the second container portion enters into the chamber 5 of the first container portion.

Figure 4:
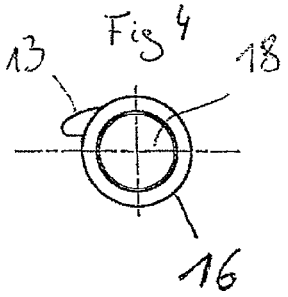
FIG. 4 is an upper view of the first embodiment.
Figure 8:
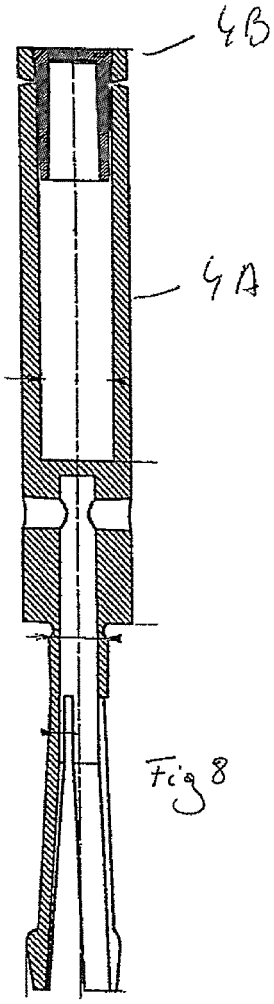
FIG. 8 is a transverse cross section view of the cap of FIG. 7.
Figure 7:
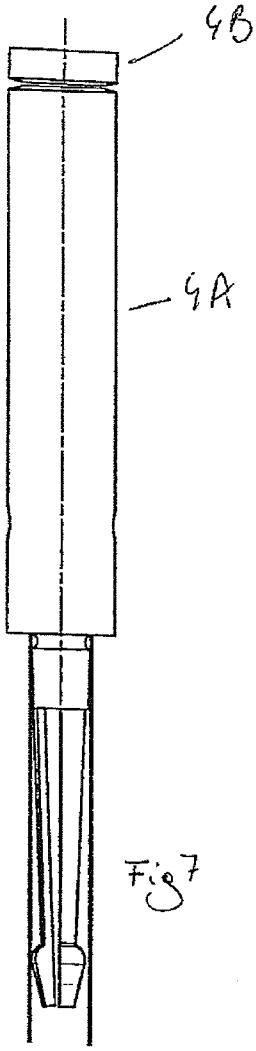
FIG. 7 is an exploded side elevation view of the first embodiment after tearing the band and after closing back the container.

As the opening of the container needs the tearing away of the band 6, it is possible by a simple view control to determine whether a container has been opened by an employee before giving the cap or the straw with cap to a client or a guest. Indeed, when being opened the skirt of the second container portion is visible or in case the skirt 19 of the plug 18 has been pushed into the chamber 5 of the first container portion, the total length of the cap is reduced. (sees FIGS. 7 and 8) It enables thus to deliver at least one article or at least two different articles in a randomly way to several people, without prior knowledge of the winning cap(s) or loosing caps by distributing to several persons drinking straws provided with a cap as disclosed in the present specification.

In order to still improve the check of the non opening of the cap before the distribution thereof in a random way, the skirt of the plug is advantageously made in a colour different from the colour of the first container portion 4A, as well as in a colour different from the colour of the ring 16 of the second container portion. Said plug has advantageously a fluorescent/phosphorescent colour. Said skirt can also have an outer surface with different aspects (with or without colour difference, preferably with colour difference), such as the presence of one or more marking, such as lines, designs, points, a rugosity different from that of the band 6, coating with a different feeling or touch, etc. This could be very helpful for people having problems with the view.

As soon as the band 6 is removed away, the coloured skirt will be well visible.

In order to be able to see a portion of the skirt 19 after pushing it into the chamber 5 of the first container portion 4A, the inner wall of the chamber 5 of the first container portion 4A is provided with a stop 20 (see FIG. 17) for limiting the entry of the skirt 19 into the chamber 5. This enables that after pushing the skirt 19 into the chamber 5, the free end of the skirt 19 abuts the stop 20, whereby leaving a ring portion of the skirt still visible. The stop 20 can have other forms, such as the form of one or more fins parallel to the central axis B of the chamber 5, fins extending up to the bottom of the chamber 5 of the first container portion 4A (see FIG. 14).

In order to prevent, after sealing the opening 17 of the chamber 5 with the plug 18 of the cap with the band not torn, an easy removal of the plug 18 from the ring 16 of the second container portion, the skirt 19 of the plug is advantageously provided with a groove 22 adapted to receive a ring extension 21 on a inner wall of the band 6 and/or the first container portion 4A. When the plug 18 seals the opening 17, the ring extension 21 extends within the groove 22, so as prevent removal of the plug 18 in its sealing position to be removed when the band is not torn away.

The band can possibly be provided with a groove adapted to receive an abutment portion or a stop portion of the skirt 19 of the plug 18.

Figure 19:
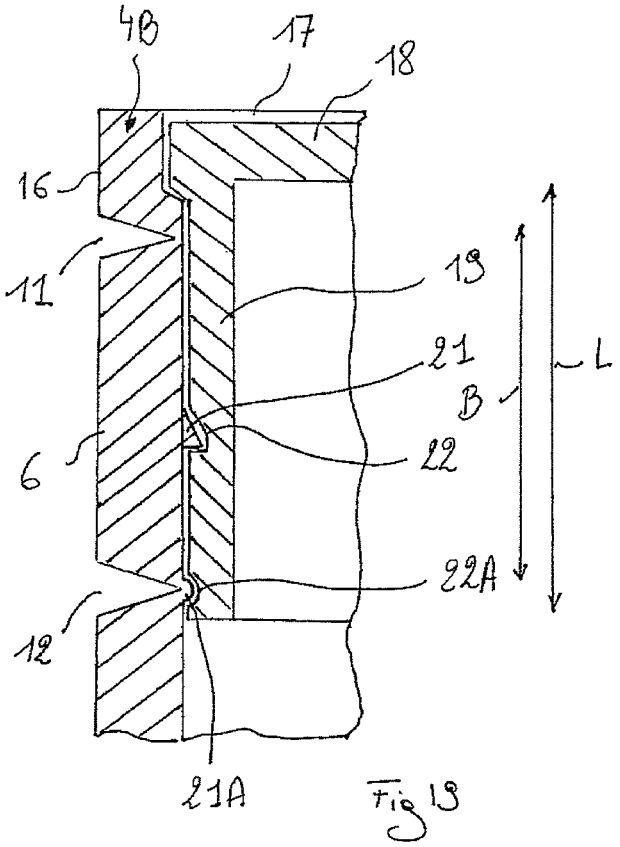
FIG. 19 is a further enlarged fragmentary detail view in cross section of the tearing band of the embodiment of FIG. 14, with the plug 18 sealing the upper opening of the container chamber.

In the embodiment of FIG. 19, the skirt 19 has adjacent to its free end a second annular groove 22A adapted to receive a annular protrusion 21A located at the level of the cut 12.

The cap of FIG. 1 is manufactured in two pieces, namely a first piece comprising the body 7, the first container portion, the band 7 and the ring 16 of the second container portion, and a second piece consisting of the plug 18. (see FIG. 14) As the opening 17 is not closed by the plug 18, employee and/or manager can place article, awards, a perfume, etc. into the chamber of one or more open cap before sealing the opening 17 of each cap with a plug 18. For losing cap, the chamber is provided with a losing article, award, etc. having advantageously the same weight as the winning article, winning awards, etc, before sealing the opening 17 with similar plug as used for the winning caps.

Winning caps and losing caps can then be mixed together, whereby not allowing to determine by advance if a cap contains a winning article/award or a losing article/awards.

In the embodiment of FIG. 1, the band 6 when torn enables a complete separation of the second container portion with respect to the first container portion. The band 6 in said embodiment extends all around the wall of the container 4, i.e. the first end of the band 6 to be torn being adjacent to the other end of the band to be torn at the end of the tearing operation.

Figure 6:
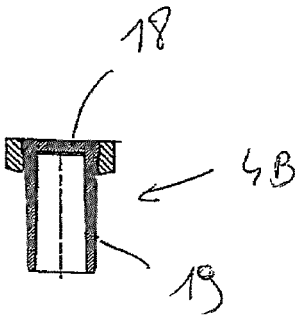
FIG. 6 is a cross section view of the first embodiment after tearing the band.
Figure 6:
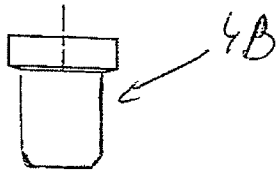
Figure 6:
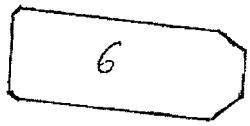
Figure 6:
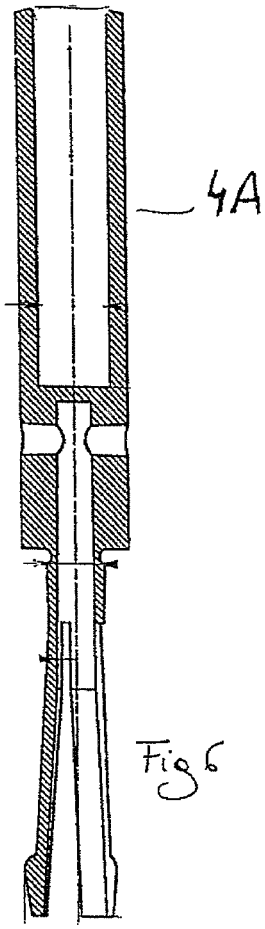
Figure 20:
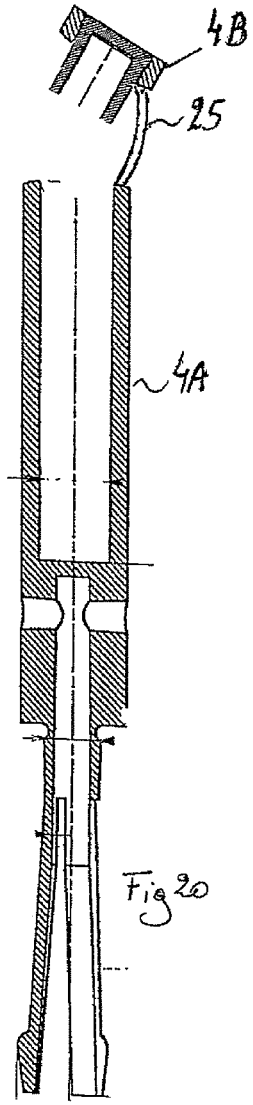
FIG. 20 is a view similar to FIG. 6 of a yet further embodiment in which the first container portion and the second container portion are attached together by a flexible link after tearing of the band.

According to a further embodiment similar to that of FIG. 6, the band 6 extends not all around the wall of the container 4, whereby after tearing the band, a flexible bridge 25 still forms a link between the first container portion 4A and the second container portion 4B. (see FIG. 20)

In the embodiment of FIG. 1, the body 7 is provided with one flexible leg 8*bis*. Before being inserted into the drinking channel 3 of the straw 2, the leg 8*bis* has a protuberance 8A which is away from the central axis B by a distance which is greater than the distance separating the protuberance 8A of the two other legs 8 from said central axis B. Thus when not inserted into the drinking channel of the straw 2, the protuberances 8A of the three legs 8, *bis* extend along a circle with a radius grater that the radius of the straw.

For inserting the legs 8 into the drinking channel 3 of the straw, a pressure has to be exerted on the legs 8,8*bis* so that at least the leg 8*bis* is moved towards the two other legs 8, whereby the protuberances 8A of the legs 8, 8*bis* extend along a circle with a radius lower that the radius of the drinking channel 3.

After inserting the legs 8,8*bis* into the drinking channel 3, the legs moved away from their compacted position, whereby the protuberances 8A move towards and contact the inner wall of the drinking channel. The legs can, if required, further pushed within the drinking channel 3, so that a face of the body 7 contacts the upper edge end of the straw 2.

The protuberances 8A of said legs lay, when not being inserted within the drinking channel 3 of the straw 2, along an outer circle with a diameter comprised advantageously between 1.5 and 1.9 times the diameter of the portion of the straw adjacent to the upper end, in which the legs have to be inserted.

In the embodiment of FIG. 1, the body 7 comprises:

(a) a first body portion 70 attached or connected to the container 4, and (b) a second body portion 71 (in the form of a tube) adapted to enter within the drinking channel 3, whereby the means for forming the air passage between the drinking channel and the gas atmosphere when said second body portion extends within the drinking channel comprises at least an air channel 90 extending in the first body portion 70 and in the second body portion 71.

The air channel 90 extending into the first body portion comprises:

(a) a first channel portion 90A extending between an opening (bottom opening 90E) of the second body portion (tube) 71 directed towards the drinking channel 3 when the said second body portion 71 extends within the drinking channel 3 of the straw 2, and an upper closed end 90C directed towards the container 4 (said upper closed end laying in the first body portion 70), and (b) two second channel portions 90B extending each between an opening 90D located between the upper closed end 90C and the bottom opening 90E of the first channel portion 90A, and an opening 90F located along the lateral outer face of the first body portion 70.

The two second channel portions 90B are advantageously aligned with an central axis C substantially perpendicular to the axis B. An angle of about 180° is thus formed between the two second channel portions 90B, with respect to the axis B.

The air channel portion 90A and advantageously 90B have advantageously a diameter or a cross section adapted for enabling the natural downwards flowing of drinking liquid, in case drinking liquid would enter within the said air channel. For example, said channel portion will have a diameter (In the present specification diameter means diameter or equivalent diameter, the equivalent diameter being equal to 4 times the open section divided by the periphery of the open section) of at least 2 mm, preferably comprised between 2.5 mm and 6 mm.

Figure 11:
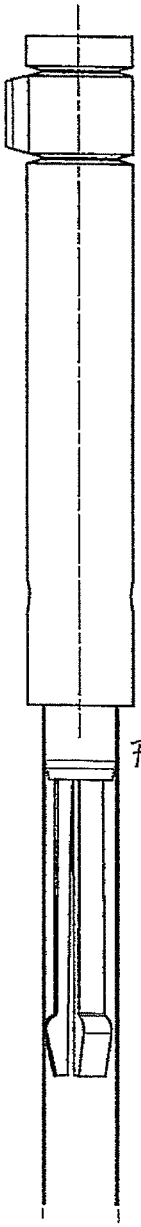
FIG. 11 is a side elevation view of a second embodiment of a cap of the invention similar to the embodiment of FIG. 1.

The cap of FIG. 11 is similar to the cap of FIG. 1, except that a sleeve 30 is glided onto the tube or second body portion 71, so as to increase the outer diameter of the second body portion 71 in function of the inner diameter of the straw.

Figure 12:
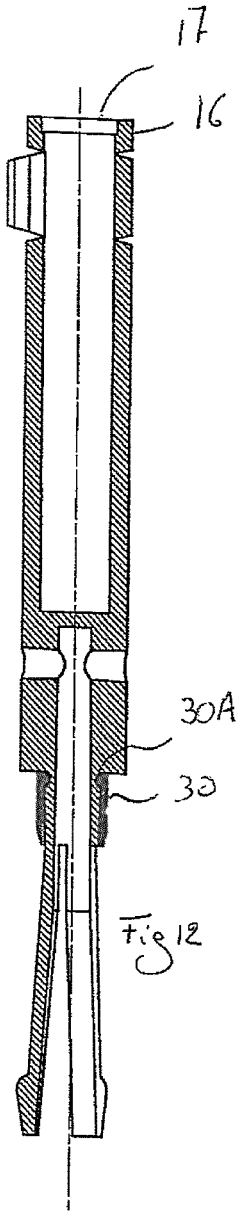
FIG. 12 is a cross section view of the embodiment of FIG. 11.
Figure 13:
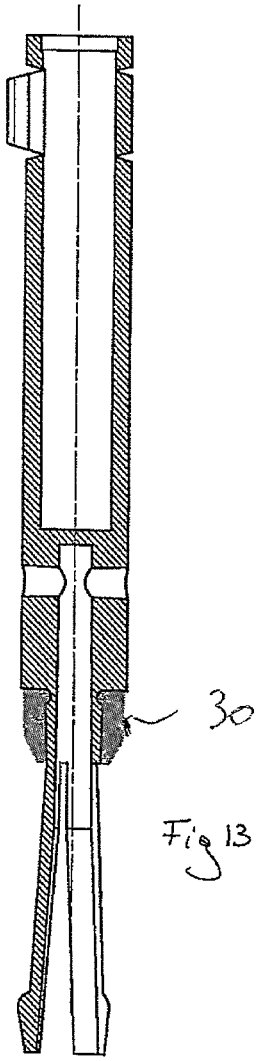
FIG. 13 is an enlarged, fragmentary cross section view of still a further embodiment similar to the embodiment of FIG. 12.

In order to prevent accidental removal of the sleeve 30, the sleeve is provided with an annular protuberance 30A adapted to be fitted into an annular groove 71A of the second body portion 71. FIG. 12 is a cross section view of the cap of FIG. 11 without the plug 18. FIG. 13 is a view similar to FIG. 12, but with a thicker sleeve 30.

Figure 21:
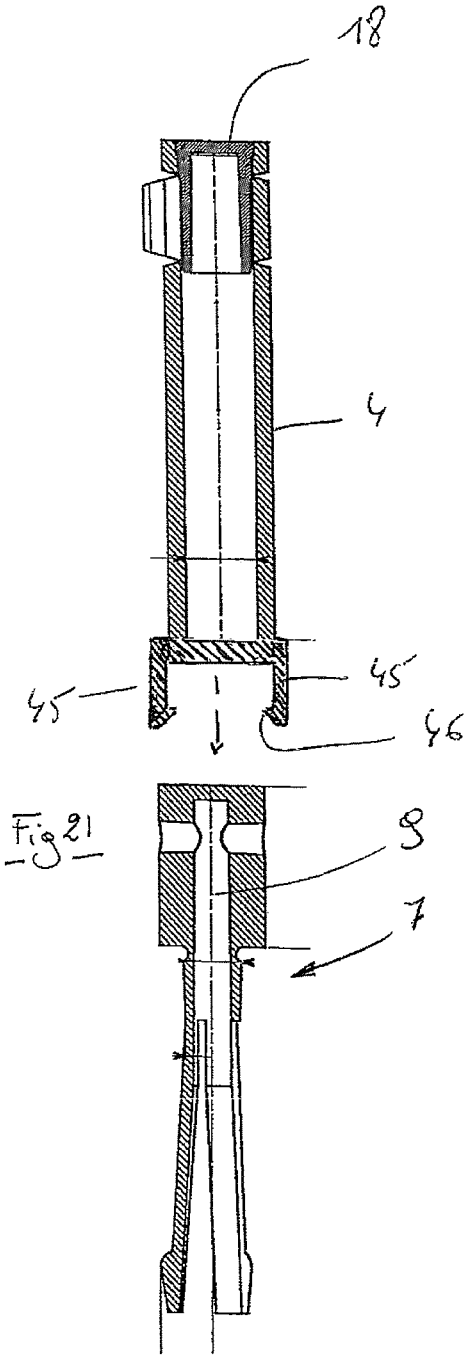
FIG. 21 is an exploded cross section view of a further embodiment of a cap in accordance with the present invention comprising a container and an independent body which are adapted to be clipped together.

The cap of FIG. 21 comprises three pieces, namely a piece 7 with the air channel 9, a container 4, and a plug 18.

The container 4 is attached on the piece 7 by clipping. For example, the container is provided with two arms 45 with fingers 46 adapted to be inserted within the second channel portions 90B.

The caps disclosed in the embodiments shown in the figures are suitable for delivering at least one article or at least two different articles in a randomly way by distributing to several persons drinking straws provided with a cap, each drinking straw being advantageously distributed with a drinking glass. Said method for randomly distributing winning articles and non winning articles comprises the following steps:

providing a series of caps with the closing plug away from the ring 16 so that the opening 17 forms an opening for the container chamber 5, introducing at least one article through the opening 17 into the chamber 5 in one or more caps or introducing one article through the opening 17 into the chamber 5 in some caps and introducing another article (for example non winning article) through the opening 17 into the chamber 5 for some other caps, closing the opening 17 of the second container portion of the caps by pushing closing plug into the opening 17, before or after associating the caps with drinking straws;

randomly mixing the caps or the straws provided with the caps;

randomly distributing the drinking straws with closed caps, advantageously with drinking glasses and/or drinking bottles to people, whereby each person receiving a drinking straw provided with a closed cap, possibly after removing the cap from the drinking straw, has to tear the band so as to have access to the chamber of the container, so as to collect the article (winning or non winning) possibly present within the chamber of the cap. When receiving a straw provided with a cap, the people or guest can determine whether or not the cap has already been opened.

Figure 22:
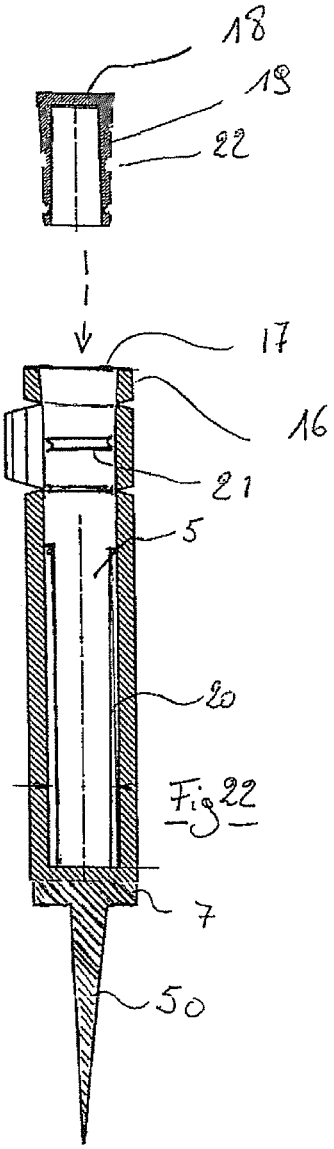
FIG. 22 is an exploded cross section view of another embodiment of a cap in accordance with the present invention similar to the embodiment of FIG. 14 having a pinlike shaped element and shown prior to closing of the cap with a sealing member.

The cap of FIG. 22 is similar to the cap of shown in FIG. 14, except that the body 7 comprises a pin like shaped element 50 adapted to enter or prick into a food for facilitating the individual eating of said food, and/or for generating some fun and surprise when eating some meals, lunch, diner, such as during a party or a reception, etc. The cap of FIG. 22 can also be pricked into a cloth, such as into a tie, etc. The pin like shaped element 50 can optionally replaced by a clip element, a ring, etc. so as to attach the cap, for example to a finger, an ear, etc.

Figure 23:
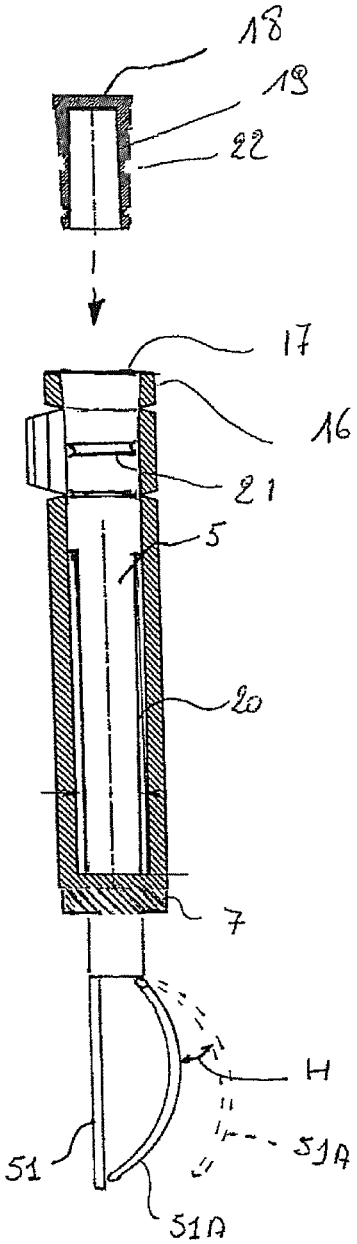
FIG. 23 is an exploded cross section view of a further embodiment of a cap in accordance with the present invention similar to that shown in FIGS. 14 and 22 wherein the pinlike shaped element is replaced by a clip.

The cap of FIG. 23 is similar to that of FIG. 22, except that the pin 50 has been replaced by a clip mechanism 51, for example suitable for attaching to an ear. Said mechanism has a pivoting portion 51A (arrow H).

Figure 24:
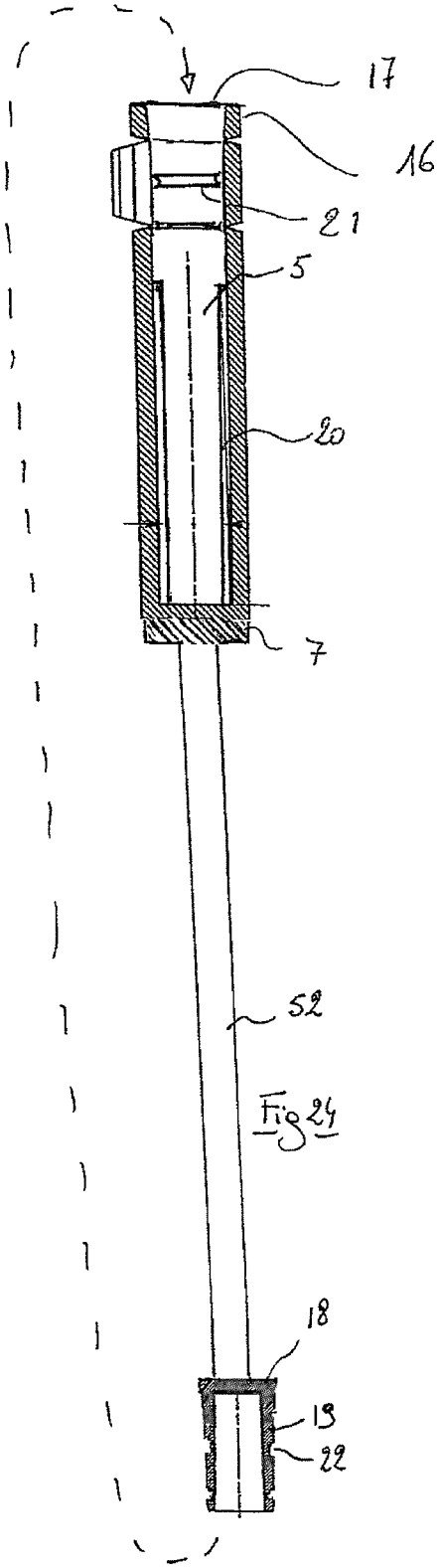
FIG. 24 is a cross section view of an additional embodiment of a cap in accordance with the present invention similar to the cap of FIGS. 14 and 22 wherein the pinlike shaped element is replaced by a flexible band, one end of which is attached to a plug.

The cap of FIG. 24 is similar to the cap of FIG. 22, except that the pin 50 has been replaced by a flexible band 52, the end of which is attached to the plug 18 adapted to close the opening 17 of the cap 4. When closing the opening 17 by the plug 18, the band forms a ring.

The caps as shown in the figures can also be used as such for distributing awards, messages, etc in a randomly way. The invention further relates then to a cap comprising a container provided with at least one wall defining a chamber adapted for receiving an article, and with an element to be torn at least partly from one of said wall for enabling to have access to the article present within the chamber, possibly after removal of a sealing means, in which the element to be torn is a band of the container wall(s) extending between a first container portion and a second container portion, whereby said band is adapted when torn from the container wall(s) for allowing at least a relative motion between the first and second container portions, preferably a take away motion between the first container portion and the second container portion.

Said cap has then one or more further characteristics of the two other caps of the invention, especially one or more characteristics as stated in the attached claims

What I claim is:

1. A cap for a drinking channel of a drinking straw for drinking a liquid contained in a recipient placed in an air atmosphere, said cap being adapted to be removably mounted with respect to an upper end of the drinking channel of the drinking straw, said cap comprising:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, and in which the element to be torn is a band of the container wall extending between the first container portion part and the second container portion part, whereby said band is adapted when torn from the container wall for allowing at least a relative motion between the first container portion part and the second container portion part.

2. The cap of claim 1, whereby said band is adapted when torn from the container wall for allowing at least a relative take away motion between the first container portion part and the second container portion part.

3. The cap of claim 1, in which the band of the container to be torn from the container wall for allowing a relative motion between the first container portion part and the second container portion part is selected from the group consisting of a band adapted to be taken away from the first container portion part, a band adapted to be taken away from the second container portion part, and a band adapted to be taken away from the first container portion part and from the second container portion part.

4. A cap for a drinking channel of a drinking straw for drinking a liquid contained in a recipient placed in an air atmosphere, said cap being adapted to be mounted removable with respect to an upper end of the drinking channel of the drinking straw, said cap comprising:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, in which the element to be torn is a band of the container wall extending between the first container portion part and the second container portion part, whereby said band is adapted when torn from the container wall for allowing at least a relative motion between the first container portion part and the second container portion part, in which before the tearing off of the band, the container has an inner volume, in which the cap further comprises a securing means adapted to secure together the first container portion part and the second container portion part after tearing of the band to be torn, wherein when the first container portion part and the second container portion part are secured together after the tearing of the band, a closed container is formed having an inner volume lower than the volume of the closed container before the tearing off of the band.

5. The cap of claim 4, in which the first container portion part defining a first container volume is attached to the body, while the second container portion part is adapted to be moved away from the first container portion part after tearing off the band from the container wall, whereby the second container portion part is provided with means adapted to enter at least partly within the first container volume of the first container portion part so as to close at least partly said first container portion part.

6. The cap of claim 4, in which the first container portion part defines a first inner volume, and in which the second container portion part comprises at least two distinct parts said at least two distinct parts including:

(a) a support with an opening and defining a support inner volume, and (b) a closing element adapted to close said opening when pushed on said support, wherein the closing element has at least one means having an end extending outside said support inner volume and adapted for entering at least partly into the first container portion part first inner volume so as to connect, in a releasable manner, the second container portion part onto the first container portion part.

7. The cap of claim 4, in which the first container portion part defines a first inner volume, in which the second container portion part comprises at least two distinct parts, said at least two distinct parts including:

(a) a support with an opening and defining a support inner volume, and (b) a closing element adapted to close said opening when pushed on said support, wherein the closing element has at least one means having an end extending outside said support inner volume and adapted for entering at least partly into the first container portion part first inner volume so as to connect, in a releasable manner, the second container portion part onto the first container portion part, and in which the closing element is adapted to work with the support and/or the band adapted to be torn, when pushed through the opening of the support of the second container portion part and when the band is not torn, for blocking the closing element and preventing its withdrawal from the container.

8. The cap of claim 7, in which the closing element comprises a skirt provided along its outer face, with at least one groove or protuberance, while the band to be torn is provided, on its face directed towards the chamber of the container, with at least one groove or protuberance, whereby the protuberance of the skirt is adapted to enter with the groove of the band or to abut against the protuberance of the band for preventing the removal of the closing element at least as long as the band is not torn or whereby the groove of the skirt is adapted to receive a protuberance of the band to be torn for preventing the removal of the closing element at least as long as the band is not torn.

9. The cap of claim 2, in which before the tearing off of the band, the container has an inner volume, whereby the cap further comprises a securing means adapted to secure together the first container portion part and the second container portion part after tearing of the band to be torn, wherein when the first container portion part and the second container portion part are secured together after the tearing of the band, a closed container is formed having an inner volume lower than the inner volume of the closed container before the tearing off of the band.

10. A cap for a drinking channel of a drinking straw for drinking a liquid contained in a recipient placed in an air atmosphere, said cap being adapted to be removably mounted with respect to an upper end of the drinking channel of the drinking straw, said cap comprising:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, in which the drinking straw has an inner wall defining the drinking channel, in which the body comprises at least two legs adapted to enter at least partly within the drinking channel through said upper end of the straw, in which at least one of said at least two legs is the at least one flexible element adapted to exert a pressure on a wall of the drinking straw when said portion of the body extends at least partly within the drinking channel, and in which said legs are each provided with a protuberance adapted to contact the inner wall of the straw when said legs enter within the drinking channel.

11. The cap of claim 10, for a straw having a drinking channel with a portion adjacent to the upper end with a central axis and a substantially circular cross section having a diameter, whereby the body comprises three legs each provided with a protuberance, in which at least one of said three legs is the at least one flexible element adapted to exert a pressure on a wall of the drinking straw when said portion of the body extends at least partly within the drinking channel, and in which the protuberance of said legs lays along an outer circle with a diameter greater than the diameter of the portion of the straw adjacent to the upper end.

12. A cap for a drinking channel of a drinking straw for drinking a liquid contained in a recipient placed in an air atmosphere, said cap being adapted to be removably mounted with respect to an upper end of the drinking channel of the drinking straw, said cap comprising:

a container provided with at least one wall defining a chamber adapted for receiving an article, and with an element to be torn at least partly from one of said at least one wall defining the chamber, said element when being torn being adapted to allow access to the article present within the chamber, a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, in which said cap is adapted for use with a straw having a drinking channel with a portion adjacent to the upper end with a central axis and a substantially circular cross section having a diameter, in which the drinking straw has an inner wall defining the drinking channel, in which the body comprises at least three legs adapted to enter at least partly within the drinking channel through said upper end of the straw, at least one of said at least three legs is the at least one flexible element adapted to exert a pressure on a wall of the drinking straw when said portion of the body extends at least partly within the drinking channel, and in which said legs are each provided with a protuberance adapted to contact the inner wall of the straw when said legs enter within the drinking channel, and in which the protuberance of said legs lays along an outer circle with a diameter comprised between 1.2 and 2 times the diameter of the portion of the straw adjacent to the upper end.

13. The cap of claim 12, in which the protuberance of said legs lays along an outer circle with a diameter comprised between 1.5 and 1.9 times the diameter of the portion of the straw adjacent to the upper end.

14. The cap of claim 1, in which the body comprises:

(a) a first body portion attached or connected to the container, and (b) a second body portion adapted to enter within the drinking channel, wherein the means for forming the at least one air passage between the drinking channel and the air atmosphere when said second body portion extends within the drinking channel comprises at least an air channel extending in the first body portion.

15. A cap for a drinking channel of a drinking straw for drinking a liquid contained in a recipient placed in an air atmosphere, said cap being adapted to be removably mounted with respect to an upper end of the drinking channel of the drinking straw, said cap comprising:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, in which the body comprises:

(a) a first body portion attached or connected to the container, and (b) a second body portion adapted to enter within the drinking channel, and in which the second body portion comprises a tube connected to the first body portion and at least two legs, in which at least one of the legs is the at least one flexible element adapted to exert a pressure on a wall of the drinking straw when said portion of the body extends at least partly within the drinking channel, whereby the means for forming the at least one air passage between the drinking channel and the air atmosphere when said second body portion extends within the drinking channel comprises at least an air channel extending in the first body portion and said tube.

16. A cap for a drinking channel of a drinking straw for drinking a liquid contained in a recipient placed in an air atmosphere, said cap being adapted to be removably mounted with respect to an upper end of the drinking channel of the drinking straw, said cap comprising:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, in which the body comprises:

(a) a first body portion attached or connected to the container, and (b) a second body portion adapted to enter within the drinking channel, wherein the means for forming the at least one air passage between the drinking channel and the air atmosphere when said second body portion extends within the drinking channel comprises at least an air channel extending in the first body portion, and in which the first body portion has a lateral face, whereby the air channel extending in the first body portion has at least one opening along the lateral face of the first body portion.

17. A cap for a drinking channel of a drinking straw for drinking a liquid contained in a recipient placed in an air atmosphere, said cap being adapted to be removably mounted with respect to an upper end of the drinking channel of the drinking straw, said cap comprising:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, and in which the body comprises:

(a) a first body portion attached or connected to the container, said first body portion having a lateral face, and (b) a second body portion adapted to enter within the drinking channel, wherein the means for forming the at least one air passage between the drinking channel and the air atmosphere when said second body portion extends within the drinking channel comprises at least an air channel extending in the first body portion, and in which the air channel extending into the first body portion comprises:

(a) a first channel portion extending between an opening directed towards the drinking channel when said second body portion extends within the drinking channel of the straw, and an upper closed end directed towards the container, and (b) a second channel portion extending between an opening located between the upper closed end and the opening of the first channel portion directed towards the drinking channel when said second body portion extends within the drinking channel of the straw, and an opening located along the lateral face of the first body portion.

18. The cap of claim 17, in which the air channel comprises at least two second channel portions, each of said second channel portions extending between an opening located between the upper closed end and the opening of the first channel portion directed towards the drinking channel when said second body portion extends within the drinking channel of the straw, and an opening located along the lateral face of the first body portion, whereby each of said at least two second channel portions is a substantially rectilinear channel with a central axis, whereby an angle is formed between the central axis of said at least two second channel portions, said angle being comprised between 90° and 270°.

19. The cap of claim 1, in which the at least one air passage between the drinking channel and the air atmosphere has a diameter adapted for enabling the natural flowing of drinking liquid, in case drinking liquid would enter within said at least one air passage.

20. A drinking straw having a drinking channel for drinking a liquid contained in a recipient placed in an air atmosphere, said drinking straw being provided with a cap adapted to be mounted removable with respect to an upper end of the drinking channel of the drinking straw, in which said cap comprises:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, and in which the element to be torn is a band of the container wall extending between the first container portion part and the second container portion part, whereby said band is adapted when torn from the container wall for allowing at least a relative motion between the first container portion part and the second container portion part.

21. A drinking straw having a drinking channel for drinking a liquid contained in a recipient placed in an air atmosphere, said drinking straw being provided with a cap adapted to be mounted removable with respect to an upper end of the drinking channel of the drinking straw, in which said cap comprises:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, whereby the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, in which, before the tearing of the element to be torn, the container comprises a first container portion part and a second container portion part attached to the first container portion part, in which the element to be torn is a band of the container wall extending between the first container portion part and the second container portion part, whereby said band is adapted when torn from the container wall for allowing at least a relative motion between the first container portion part and the second container portion part, in which before the tearing off of the band, the container has an inner volume, in which the cap further comprises a securing means adapted to secure together the first container portion part and the second container portion part after tearing of the band to be torn, wherein when the first container portion part and the second container portion part are secured together after the tearing of the band, a closed container is formed having an inner volume lower than the volume of the closed container before the tearing off of the band.

22. The drinking straw of claim 21, in which the first container portion part of the cap defining a first container volume is attached to the body, while the second container portion part is adapted to be moved away from the first container portion part after tearing off the band from the container wall, whereby the second container portion part is provided with means adapted to enter at least partly within the first container volume of the first container portion part so as to close at least partly said first container portion part.

23. The drinking straw of claim 21, in which the first container portion part defines a first inner volume, and in which the second container portion part of the cap comprises at least two distinct parts said at least two distinct parts including:

(a) a support with an opening and defining a support inner volume, and (b) a closing element adapted to close said opening when pushed on said support, wherein the closing element has at least one means having an end extending outside said support inner volume and adapted for entering at least partly into the first container portion part first inner volume so as to connect, in a releasable manner, the second container portion part onto the first container portion part, in which the closing element is adapted to work with the support and/or the band adapted to be torn, when pushed through the opening of the support of the second container portion part and when the band is not torn, for blocking the closing element and preventing its withdrawal from the container.

24. The drinking straw of claim 21, in which the drinking straw has an inner wall defining the drinking channel, in which the body comprises at least two legs adapted to enter at least partly within the drinking channel through said upper end of the straw, in which at least one of said at least two legs is the at least one flexible element adapted to exert a pressure on a wall of the drinking straw when said portion of the body extends at least partly within the drinking channel, and in which said legs are each provided with a protuberance adapted to contact the inner wall of the straw when said legs enter within the drinking channel.

25. The drinking straw of claim 21, in which the body of the cap comprises:

(a) a first body portion attached or connected to the container, and (b) a second body portion adapted to enter within the drinking channel, wherein the means for forming the at least one air passage between the drinking channel and the air atmosphere when said second body portion extends within the drinking channel comprises at least an air channel extending in the first body portion.

26. The drinking straw of claim 21, in which the body of the cap comprises:

(a) a first body portion attached or connected to the container, said first body having a lateral face, and (b) a second body portion adapted to enter within the drinking channel, wherein the means for forming the at least one air passage between the drinking channel and the air atmosphere when said second body portion extends within the drinking channel comprises at least an air channel extending in the first body portion, and in which the air channel extending into the first body portion comprises:

(a) a first channel portion extending between an opening directed towards the drinking channel when said second body portion extends within the drinking channel of the straw, and an upper closed end directed towards the container, and (b) a second channel portion extending between an opening located between the upper closed end and the opening of the first channel portion directed towards the drinking channel when said second body portion extends within the drinking channel of the straw, and an opening located along the lateral face of the first body portion.

27. The drinking straw of claim 26, in which the air channel of the first body portion of the cap comprises at least two second channel portions, each of said second channel portions extending between an opening located between the upper closed end and the opening of the first channel portion, and an opening located along the lateral face of the first body portion, whereby each of said at least two second channel portions is a substantially rectilinear channel with a central axis, whereby an angle is formed between the central axis of said at least two second channel portions, said angle being comprised between 90° and 270°.

28. The drinking straw of claim 21, in which the at least one air passage between the drinking channel and the air atmosphere has a diameter adapted for enabling the natural flowing of drinking liquid, in case drinking liquid would enter within said at least one air passage.

29. A method for delivering at least one article in a randomly way by distributing to several considered persons drinking straws each provided with a closed cap, whereby a series of closed caps is randomly distributed to said several considered persons, each with a drinking straw, in which the drinking straws have each a drinking channel for drinking a liquid contained in a recipient placed in an air atmosphere, said drinking straws being each provided with a closed cap adapted to be mounted removable with respect to an upper end of the drinking channel of the drinking straw, in which each closed cap of said series of closed caps comprises:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, wherein the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, said method comprising the following steps:

providing a series of closed caps, at least one of which being provided with an article within its chamber, associating the closed caps of said series of closed caps with drinking straws, randomly distributing the drinking straws, each with a closed cap to the persons, tearing off by each considered person receiving a drinking straw provided with a closed cap of the series of closed caps, of the element of said closed cap which is provided to the drinking straw received by the considered person, so that each considered person has access to the chamber of the container of the closed cap which is provided to the drinking straw received by the considered person.

30. The method of claim 29, further comprising delivering at least one first article through one closed cap of the series of closed caps and at least one series of second articles different from said first article through other closed caps of the series of closed caps.

31. A method for delivering at least one article in a randomly way by distributing to several considered persons drinking straws each provided with a closed cap, whereby a series of closed caps is randomly distributed to said several considered persons, in which the drinking straws have each a drinking channel for drinking a liquid contained in a recipient placed in an air atmosphere, said drinking straws being each provided with a closed cap adapted to be mounted removable with respect to an upper end of the drinking channel of the drinking straw, in which each closed cap of said series of closed caps comprises:

a container provided with at least one wall defining a chamber adapted for receiving an article, and with an element to be torn at least partly from one of said at least one wall defining the chamber, said element when being torn being adapted to allow access to the article present within the chamber;

a body having one end attached to the container or a part thereof and another end provided with a portion having an outer shape adapted to enter at least partly within the drinking channel through said upper end of the straw, said body comprising at least one flexible element adapted to exert a pressure on a wall of the drinking straw when said portion of the body extends at least partly within the drinking channel, wherein the body is selected form the group consisting of (a) a body having a shape adapted to form with the drinking channel at least one air passage between the drinking channel and the air atmosphere when said portion extends at least partly within the drinking channel, (b) a body comprising means for defining at least one air passage between the drinking channel and the air atmosphere when said portion extends at least partly within the drinking channel, and (c) a body having a shape adapted to form with the drinking channel at least one first air passage between the drinking channel and the air atmosphere when said portion extends at least partly within the drinking channel, said body further comprising means for defining at least one second air passage between the drinking channel and the air atmosphere when said portion extends at least partly within the drinking channel, and in which, before the tearing of the element to be torn, the container comprises a first container portion part and a second container portion part attached to the first container portion part, in which the element to be torn is a band of the container wall extending between the first container portion part and the second container portion part, whereby said band is adapted when torn from the container wall for allowing at least a relative motion between the first container portion part and the second container portion part, in which the second container portion part comprises at least two distinct parts said at least two distinct parts including:

(a) a support with an opening and defining a support inner volume, and (b) a closing element adapted to close said opening when pushed on said support, said method comprising the following steps:

providing a series of open caps with the closing element not closing the opening of the support of said second container portion part, said series of open caps being adapted to form the series of closed caps after closing the opening of the support of the second container portion part of each open cap with the closing element;

introducing at least one article through the opening of the support into the chamber of at least one open cap of the series of open caps, for the open caps of the series of open caps, pushing the closing element into said opening of said open caps so as to close the chamber thereof and so as to form a series of closed caps, associating the closed caps of said series of closed caps with drinking straws, randomly distributing the drinking straws each provided with a closed cap to the considered persons, tearing off the band of the closed cap by each considered person receiving a drinking straw provided with one closed cap of the series of closed caps, so that each person has access to the chamber of the container.

32. The method of claim 31, further comprising delivering at least one first article through one closed cap of the series of closed caps and at least one series of second articles different from said first article through other closed caps of the series of closed caps.

33. The method of claim 31, using closed caps in which the first container portion part defines a first inner volume, and in which the second container portion part of the cap comprises at least two distinct parts:

(a) a support with an opening and defining a support inner volume, and (b) a closing element adapted to close said opening when pushed on said support, wherein the closing element has at least one means having an end extending outside said support inner volume and adapted for entering at least partly into the first container portion part first inner volume so as connect, in a releasable manner, the second container portion part onto the first container portion part, said method comprising the further following step after the tearing off of the element of the closed cap by each considered person receiving a drinking straw provided with one closed cap of the series of closed caps, so that each considered person has access to the chamber of the container, for each open cap, connecting back the second container portion part onto the first container portion part, by pushing the end extending outside the support inner volume at least partly into the first container portion part first inner volume.

* * * * *